US007650086B2

(12) United States Patent
Takahashi et al.

(10) Patent No.: US 7,650,086 B2
(45) Date of Patent: Jan. 19, 2010

(54) IMAGE FORMING APPARATUS, AND TONER RECYCLE METHOD

(75) Inventors: Masashi Takahashi, Yokohama (JP); Minoru Yoshida, Machida (JP); Takeshi Watanabe, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 568 days.

(21) Appl. No.: 11/481,383

(22) Filed: Jul. 5, 2006

(65) Prior Publication Data

US 2008/0008481 A1 Jan. 10, 2008

(51) Int. Cl.
*G03G 15/08* (2006.01)

(52) U.S. Cl. ..... 399/27; 399/28; 399/35; 399/61; 399/359

(58) Field of Classification Search ..... 399/27, 399/28, 35, 61, 359
See application file for complete search history.

(56) References Cited

U.S. PATENT DOCUMENTS

2004/0228656 A1* 11/2004 Kamimura ..... 399/299
2006/0002750 A1* 1/2006 Ono ..... 399/359
2006/0088343 A1 4/2006 Watanabe et al.

FOREIGN PATENT DOCUMENTS

JP 2001-154439 6/2001
JP 2002-189335 7/2002
JP 2002-311669 10/2002
JP 2003-140428 5/2003
JP 2003-345096 12/2003
JP 2005266434 A * 9/2005

OTHER PUBLICATIONS

Electronic Translation of JP 2005266434.*

* cited by examiner

*Primary Examiner*—David M Gray
*Assistant Examiner*—Ryan D Walsh
(74) *Attorney, Agent, or Firm*—Turocy & Watson, LLP

(57) ABSTRACT

There is provided a technique in which when an image forming processing with toners of plural colors is performed, a residual toner on a transfer-receiving member to which toner images are transferred by plural image forming units is not discarded, but is reused as a black toner, and a deterioration in picture quality due to a change in color tone of the black toner is prevented. An image forming apparatus is for performing an image forming processing by plural image forming units to form toner images of colors different from each other on a transfer-receiving member moved in a specified direction, and includes a toner collecting unit to collect toners remaining on the transfer-receiving member, a ratio judgment unit to judge a mixing ratio of toners of plural colors included in the toners collected by the toner collecting unit, and a toner replenishing unit to replenish an insufficient color toner to the toners collected by the toner collecting unit based on the mixing ratio judged by the ratio judgment unit so that the mixing ratio becomes a specified ratio.

24 Claims, 12 Drawing Sheets

FIG.12

| COLOR DIFFERENCE | 5 | 6 | 7 | 8 | 9 | 10 |
|---|---|---|---|---|---|---|
| SENSORY EVALUATION RESULT OF COLOR TONE | OK | OK | OK | OK | △ | NG |

IMAGE FORMING APPARATUS, AND TONER RECYCLE METHOD

BACKGROUND OF THE INVENTION

1. Field of the Invention

The present invention relates to a toner recycle technique in a case where an image forming processing using toners of plural colors is performed.

2. Description of the Related Art

Heretofore, there is known an image forming apparatus adopting a so-called cleaner-less process in which after a toner image formed on a photoconductive body is transferred onto a transfer member, a toner remaining on the photoconductive body is collected in a developing unit and is reused (see JP-A-5-341643, JP-A-11-249452, Japanese Patent No. 2675554, JP-A-2002-132002, U.S. Pat. No. 4,727,395, JP-B-6-77166, Japanese Patent No. 2879883).

However, in the image forming apparatus adopting the cleaner-less process, although a cleaner-less structure is realized for the photoconductive body, waste toner is produced on an intermediate transfer body, and it can not be said that there is no waste toner in the whole apparatus. In the related art, the waste toner produced on the intermediate transfer body is discarded, and there has been a problem from the viewpoint of toner consumption cost and maintenance cost.

Then, there is disclosed a structure in which a cleaner is provided for an intermediate transfer body, and a toner removed there is returned to a black developing unit (see JP-A-2002-189335, JP-A-2002-311669, JP-A-2001-154439). In the image forming apparatus of the structure, a large amount of secondary transfer residual toner produced in the case where the intermediate transfer body is adopted can be effectively reused, however, the recycle mechanism becomes complicated. Besides, when the cleaner exists for the belt, it is difficult to control the meandering of the belt, and there is also a problem that a complicated mechanism is required. Besides, the belt is scraped by the cleaner, and the life of the belt becomes short, and further, since the cleaner itself has a life, the exchanging operation thereof and the like are required.

In the technique of the structure in which the toner removed from the intermediate transfer body is returned to the black developing unit, there is also disclosed an example in which the transfer residual toner is returned to the photoconductive body by a bias, and is finally collected in the black developing unit. However, when the whole is returned to the black developing unit by such a method, the amount of mixing of different color into the black developing unit is increased, and in some cases, the black color is also changed, and this is not preferable.

Besides, there is disclosed a technique in which respective color toners are individually collected, and when the amount of collection becomes a specific amount, they are mixed and reused (see JP-A-2003-140428, JP-A-2003-345096), in this case, the mechanisms of a collecting device, a transporting device, a mixing device and the like become complicated. Further, any of these are not the cleaner-less process.

SUMMARY OF THE INVENTION

An embodiment of the invention has an object to provide a technique in which when an image forming processing using toners of plural colors is performed, a residual toner on a transfer-receiving member to which toner images are transferred by plural image forming units is not discarded, but is reused as a black toner, and a deterioration in picture quality due to a change in color tone of the black toner is prevented.

In order to solve the foregoing problem, an image forming apparatus according to an aspect of the invention is an image forming apparatus to perform an image forming processing by plural image forming units to form toner images of colors different from each other on a transfer-receiving member moved in a specified direction, and is characterized by including a toner collecting unit to collect toners remaining on the transfer-receiving member, a ratio judgment unit to judge a mixing ratio of toners of plural colors included in the toners collected by the toner collecting unit, and a toner replenishing unit to replenish an insufficient color toner to the toners collected by the toner collecting unit based on the mixing ratio judged by the ratio judgment unit so that the mixing ratio becomes a specified ratio.

Besides, an image forming apparatus according to an aspect of the invention is an image forming apparatus to perform an image forming processing by plural image forming units to form toner images of colors different from each other on a transfer-receiving member moved in a specified direction, and is characterized by including toner collecting means for collecting toners remaining on the transfer-receiving member, ratio judgment means for judging a mixing ratio of toners of plural colors included in the toners collected by the toner collecting means, and toner replenishing means for replenishing an insufficient color toner to the toners collected by the toner collection means based on the mixing ratio judged by the ratio judgment means so that the mixing ratio becomes a specified ratio.

Besides, a toner recycle method according to an aspect of the invention is a toner recycle method for an image forming apparatus to perform an image forming processing by plural image forming units to form toner images of colors different from each other on a transfer-receiving member moved in a specified direction, and is characterized by including: collecting toners remaining on the transfer-receiving member; judging a mixing ratio of toners of plural colors included in the collected toners; and replenishing an insufficient color toner to the collected toners based on the judged mixing ratio so that the mixing ratio becomes a specified ratio.

DESCRIPTION OF THE DRAWINGS

FIG. 12 is a table showing a relation between a color difference and a sensory evaluation result of color tone.

DESCRIPTION OF THE EMBODIMENTS

Hereinafter, embodiments of the invention will be described with reference to the drawings.

Figure 1:
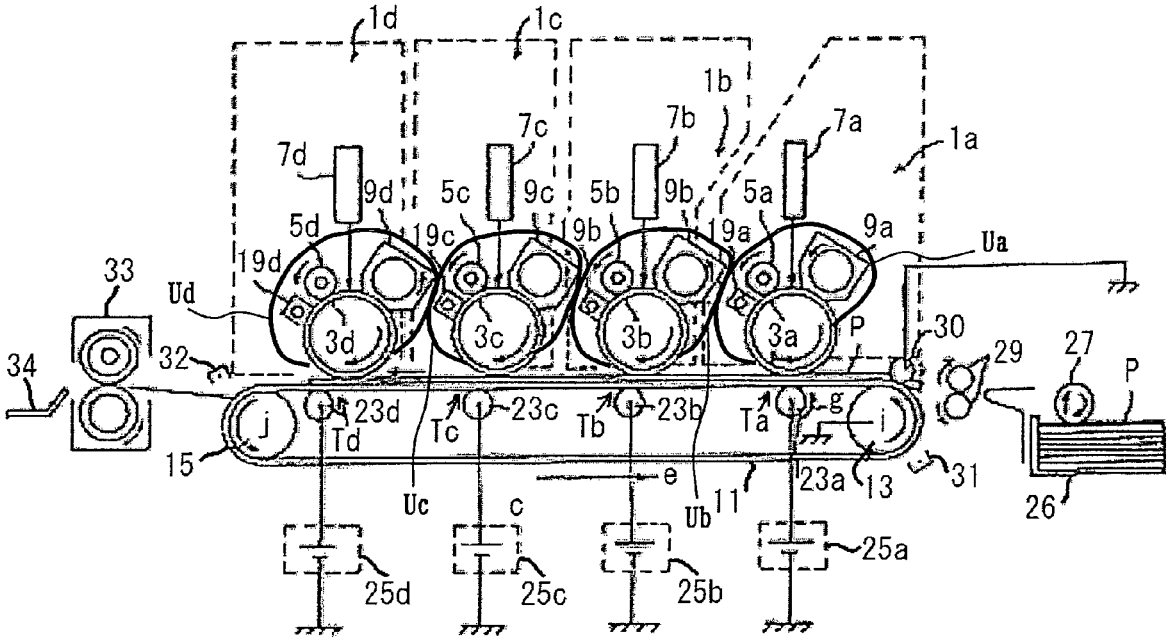
FIG. 1 is a longitudinal sectional view showing a structure of the vicinity of an image forming unit in an image forming apparatus according to an embodiment.

FIG. 1 is a longitudinal sectional view showing a structure of the vicinity of an image forming unit in an image forming apparatus according to an embodiment. In FIG. 1, image forming units (image forming means) 1*a*, 1*b*, 1*c* and 1*d* are provided. The respective image forming units include photoconductive drums 3*a*, 3*b*, 3*c* and 3*d* as image bearing bodies, and form developer images on the photoconductive bodies.

First, the image forming unit 1*a* will be described. In FIG. 1, the photoconductive drum 3*a* is a cylinder with a diameter of 30 mm, and is provided to be rotatable in an illustrated arrow direction. The following are disposed around the photoconductive drum 3*a* along a rotation direction. First, a charging roller 5*a* is provided to be in contact with the surface of the photoconductive drum 1*a*. This charging roller 5*a* uniformly negatively (−) charges the photoconductive surface of the photoconductive drum 3*a*. Instead of the charging roller, contact charging by a brush, a blade or the like, or non-contact charging by a corona wire can also be performed. An exposure device 7*a* to expose the charged photoconductive drum 3*a* to form an electrostatic latent image is provided at the downstream side (right in FIG. 1) of the charging roller 5*a*. As the exposure device here, a device to perform laser scanning or LED exposure is used. Besides, a developing unit 9*a* which contains a yellow developer and reversely develops the electrostatic latent image formed by the exposure device 7*a* by this developer is provided at the downstream side of the exposure device 7*a*. As the developer, a two-component developer including a toner and a carrier or a one-component developer including only a toner is used. As the developing system, a contact developing system or a non-contact developing system is used. Further, a transport belt 11 as transport means for transporting a sheet P as an image formed medium to the photoconductive drum 3*a* is placed at the downstream side of the developing unit 9*a*. The transport belt 11 transports the sheet P to the photoconductive drum 3*a* so that the developer image formed on the photoconductive drum 3*a* comes in contact with the sheet P. A charge removal lamp 19*a* is provided at the downstream side of the contact position between the photoconductive drum 3*a* and the sheet P. The charge removal lamp 19*a* removes the surface charge of the photoconductive drum 3*a* by uniform light irradiation after transfer. One cycle of the image formation is completed with the charge removal by the charge removal lamp 19*a*, and in a next image forming process, the charging roller 5*a* again uniformly charges the uncharged photoconductive drum 3*a*. A process unit Ua includes the photoconductive drum 3*a*, the charging roller 5*a*, the developing unit 9*a* and the charge removal lamp 19*a*, and the process unit is detachably mounted to the main body of the image forming apparatus. Incidentally, the process unit may be constructed such that at least one of the charging unit and the developing unit and the photoconductive body are integrally supported. The transport belt 11 has a size (width) almost equal to the length size of the photoconductive drum 1*a* in a direction (depth direction of the drawing) perpendicular to the transport direction (direction of an illustrated arrow e) of the sheet P. This transport belt 11 has a shape of an endless (seamless) belt, and is supported on a drive roller 15 to rotate the transport belt at a specified speed and a driven roller 13. A distance from the drive roller 15 to the driven roller 13 is about 300 mm. The drive roller 15 and the driven roller 13 are respective provided to be rotatable in illustrated arrow j and i directions (counterclockwise direction in the drawing). With the rotation of the drive roller 15, the transport belt 11 is rotated, and the driven roller 13 is driven and rotated. A sufficient tension is applied by weighting of the driven roller 13 to the outward direction so that the belt does not slip. The transport belt 11 is formed of polyimide with a thickness of 100 μm in which carbon is uniformly dispersed. The transport belt has an electric resistance of 10^10 Ωcm and exhibits semiconductivity. As the material of the transfer belt, any material may be used as long as it has a volume resistance value of 10^8 to 10^13 Ωcm and exhibits semiconductivity. For example, in addition to polyimide in which carbon is dispersed, what is obtained by dispersing conductive particles of carbon or the like into polyethylene terephthalate, polycarbonate, polytetrafluoroethylene, polyvinylidene fluoride or the like may be used. A polymer film in which conductive particles are not used and the electric resistance is adjusted by composition adjustment may be used. Further, what is obtained by mixing ion conductive material into such a polymer film, or a rubber material such as silicone rubber having a relatively low electric resistance or urethane rubber may be used.

The image forming units 1*b*, 1*c* and 1*d*, in addition to the image forming unit 1*a*, are disposed above the transport belt 11 between the drive roller 15 and the driven roller 13 along the transport direction of the sheet P. Each of the image forming units 1*b*, 1*c* and 1*d* has the same structure as the image forming unit 1*a*. Charging rollers 5*b*, 5*c* and 5*d* are provided around the respective photoconductive drums. Exposure devices 7*b*, 7*c* and 7*d* are provided at the downstream side of the charging rollers. A structure in which developing units 9*b*, 9*c* and 9*d*, and charge removal lamps 19*b*, 19*c* and 19*d* are provided at the downstream side of the exposure devices is also similar to the image forming unit 1*a*. A difference exists in a developer contained in the developing unit. The developing unit 9*b* contains a magenta developer, the developing unit 9*c* contains a cyan developer, and the developing unit 9*d* contains a black developer.

The sheet P transported by the transport belt 11 comes in contact with the respective photoconductive drums in sequence. In the vicinities of contact positions between the sheet P and the respective photoconductive drums, transfer devices 23*a*, 23*b*, 23*c* and 23*d* as transfer means are provided correspondingly to the respective photoconductive drums. That is, the transfer device 23 is provided below the corresponding photoconductive drum to come in contact with the back of the transport belt 11, and is opposite to the image forming unit through the transport belt 11. The transfer member 23*a* is connected to a positive (+) DC power supply 25*a* as voltage application means. Similarly, the transfer members 23*b*, 23*c* and 23*d* are respectively connected to DC power supplies 25*b*, 25*c* and 25*d*. On the other hand, in FIG. 1, a paper feed cassette 26 to contain the sheet P is provided at the right front of the transport belt 11. In the image forming apparatus main body, a pickup roller 27 to pick up the sheet P one by one from the paper feed cassette 26 is provided to be rotatable in an illustrated arrow f direction. A register roller pair 29 is rotatably provided between the pickup roller 27 and the transport belt 11. The register roller pair 29 supplies the sheet P onto the transport belt 11 at a specified timing. Besides, a metal roller 30 to cause the sheet P to be electrostatically absorbed on the surface of the transport belt 11 is disposed on the transport belt 11. The metal roller 30 is grounded (earthed). Besides, in order to charge the belt for the sheet adsorption, a corona charging unit 31 is mounted at the lower part of the driven roller through the transport belt 11, while the driven roller 13 of the transport belt 11 is made a counter electrode. Besides, in FIG. 1, at the left front of the transport belt 11, there are provided a fixing unit 33 to fix the developer onto the sheet P and a paper discharge tray 34 to which the sheet P fixed by the fixing unit is discharged.

Next, a color image forming process of the image forming apparatus constructed as stated above will be described. When image formation start is instructed through an operation panel (control panel) at the front of the image forming apparatus, the photoconductive drum 3*a* receives a driving force from a not-shown drive mechanism and starts to rotate. The charging roller 5*a* uniformly charges the photoconductive drum 3*a* to about −60 V. The exposure device 7*a* irradiates a light corresponding to an image to be recorded to the photoconductive drum 3*a* uniformly charged by the charging roller 5*a* and forms an electrostatic latent image. The developing unit 9*a* develops the electrostatic latent image with the developer, and forms a yellow developer image. Developer images of the respective colors are formed also on the photoconductive drum 3*b*, the photoconductive drum 3*c* and the photoconductive drum 3*d* in the same procedure as the formation of the developer image on the photoconductive drum 3*a*.

On the other hand, the pickup roller 27 takes the sheet P from the paper feed cassette 26, and the register roller pair 29 supplies the sheet P onto the transport belt 11. The transport belt 11 sequentially transports the sheet P to the photoconductive drum 3*a*, the photoconductive drum 3*b*, the photoconductive drum 3*c* and the photoconductive drum 3*d*. When the sheet P reaches a transfer area Ta formed of the photoconductive drum 3*a*, the transport belt 11 and the transfer member 23*a*, a bias voltage of about +1000 V is applied to the transfer member 23*a*. A transfer electric field is formed between the transfer member 23*a* and the photoconductive drum 3*a*, and the developer image on the photoconductive drum 3*a* is transferred onto the sheet P in accordance with the transfer electric field. The sheet P on which the developer image has been transferred in the transfer area Ta is transported to a transfer area Tb. In the transfer area Tb, a bias voltage of about +1200 V is applied to the transfer member 23*b* from the DC power supply, so that the magenta developer image is transferred to be superimposed on the yellow developer image. After the magenta developer is transferred, the sheet P is further transported to a transfer area Tc and a transfer area Td. A bias voltage of about +1400 V is applied to the transfer member 23*c* in the transfer area Tc, and a voltage of about +1600 V is applied to the transfer member 23*d* in the transfer area Td, so that the cyan developer image and the black developer image are sequentially multiply transferred to be superimposed on the already transferred developer images. The multiply transferred developer images of the respective colors as stated above are fixed onto the sheet P by the fixing unit 33, and a color image is formed. The fixed sheet P is discharged onto the paper discharge tray 34.

Figure 2:
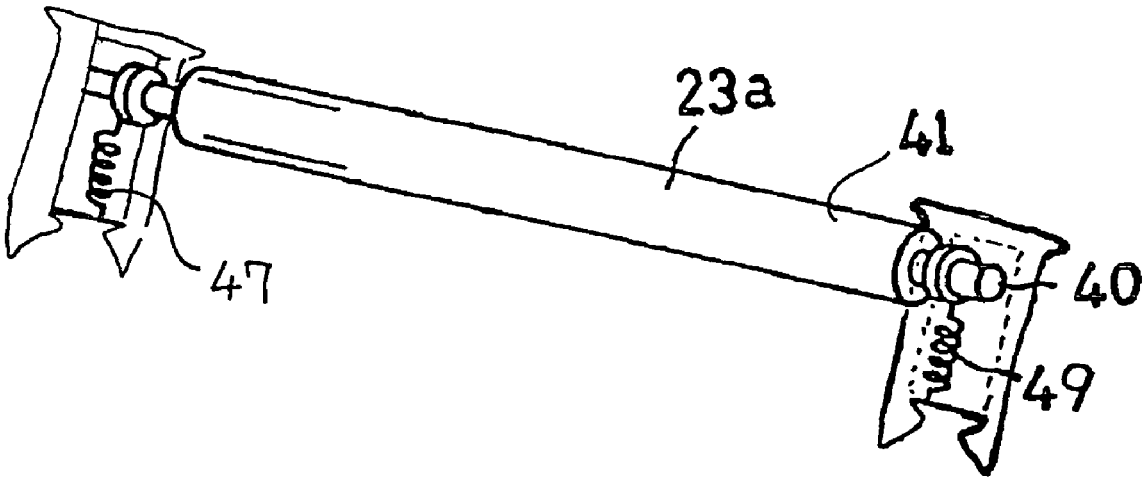
FIG. 2 is a view for explaining a portion relating to a transfer device in detail.

Subsequently, a portion relating to the transfer device will be described in more detail (see FIG. 2). The transfer device 23*a* is a conductive urethane foam roller which is made conductive by dispersing carbon. A roller 41 with an outer diameter of ϕ18 mm is molded on a cored bar 40 of ϕ10 mm. The electric resistance between the cored bar and the roller surface is about 10e6Ω. The constant voltage DC power supply 25*a* is connected to the cored bar.

The feeding device of the transfer device is not limited to the roller, but may be a conductive brush, a conductive rubber blade, a conductive sheet or the like. The conductive sheet is a rubber member dispersed with carbon or a resin film, and may be a rubber member such as silicone rubber, urethane rubber or EPDM, or a resin member such as polycarbonate. The volume resistance value is desirably 10e5 to 10e7 Ωcm.

A spring as urging means is provided at both ends of the roller shaft, and the transfer roller 23*a* is urged by the spring so that it comes in elastic contact with the transport belt 11 in the vertical direction. The magnitude of the urging force of the spring provided for each transfer roller was made 600 gft. The structure of each of the transfer devices 23*b*, 23*c* and 23*d* is similar to the transfer device 23*a*, and the structures for the elastic contact with the transport belt 11 are also the same in the respective transfer members, and accordingly, the description of the structures of the transfer devices 23*b*, 23*c* and 23*d* will be omitted.

Figure 3:
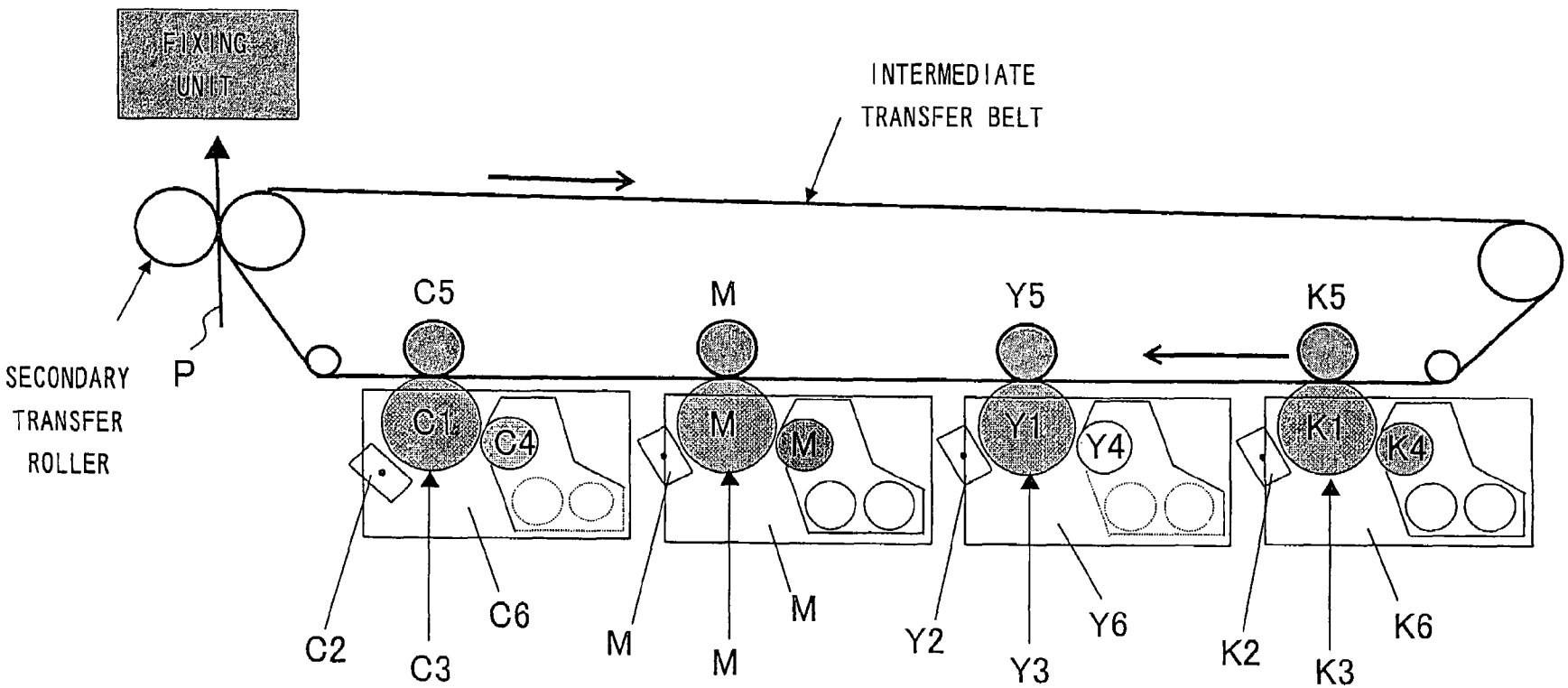
FIG. 3 is a view for explaining an image forming apparatus of an intermediate transfer system.

Incidentally, in the structural example, the transfer belt is transport means, the example of the direct transfer system has been described in which the toner image formed on the photoconductive body is directly transferred onto the sheet, and the transport belt 11 corresponds to the transfer-receiving member. Besides, no limitation is made to this, and for example, as shown in FIG. 3, the invention can also be applied to an image forming apparatus of an intermediate transfer system in which a transfer belt does not perform paper transport, and toner images formed on the photoconductive bodies of the respective image forming units are directly transferred (so-called primary transfer) onto an intermediate transfer body (transfer-receiving member) such as a belt or a roller, and then are transferred from the belt or roller to the sheet or the like at once. In this case, the toner images formed on the respective photoconductive bodies are transferred onto the intermediate transfer belt, and the secondary transfer roller and the intermediate transfer belt cooperate with each other so that the toner images are transferred onto the transported sheet at once. And then, the sheet is transported to the fixing unit, the image is fixed, and the sheet is discharged to the paper discharge tray.

The above is the image forming process of the color image forming apparatus, and as described above, the image forming processing is performed by the plural image forming units to transfer toner images of colors different from each other onto the transfer-receiving member moved in the specified direction.

Subsequently, a cleaner-less process will be described. In the image forming process shown in FIG. 1, in case of necessity, the residual toner remaining on the photoconductive body after transfer passes through a disturbance member to disturb a not-shown transfer remaining image, and the image forming process starting from the charging step of the photoconductive body is again repeated. At this time, the residual toner having passed through the charging unit is charged with the same polarity (minus polarity in this embodiment) as the charging potential of the photoconductive body since it has passed through the charging step. When this reaches the developing unit, the image portion is developed in the developing unit while it remains attached on the photoconductive body, a non-image portion is collected to the developing roller side, and so-called simultaneous development/cleaning is performed. By this, even if a cleaning device such as a blade does not exist on the photoconductive surface of the photoconductive body, the image forming process is continuously performed.

In the tandem type color image forming apparatus shown in this embodiment, (a) in order to form an image on the photoconductive body after the eccentricity of the photoconductive body, the meandering of the belt and the like are corrected, or (b) when surrounding temperature or humidity is changed, the characteristics of the photoconductive body, the charging characteristics of toner and the like are changed, which changes the amount of developing toner, and therefore, in order to deal with the variation of the amount of developing toner, in a state where an image is not printed on an image formed medium such as paper, for example, in the case of the direct transfer system (system in which a toner image formed on the photoconductive body is directly transferred to a sheet), a specific image patch is transferred onto the belt 11 as transport means, the position, reflectivity, reflection density and the like are detected by a sensor, and feedback is performed based on the values at the actual image printing. At this time, although the image patches are sequentially transferred from the respective photoconductive bodies to the belt, they are transferred at positions of the belt surface where the patches of the respective colors do not overlap with each other in the longitudinal direction of the photoconductive body, and after the reflectivity, position and the like are detected on the belt, they are returned to the respective photoconductive bodies, and are collected in the developing units. Specifically, the first color patch is printed on the first stage photoconductive body 3*a*, +350 v is applied to the first stage transfer roller 23*a*, and after the first color patch is transferred to the belt 11, +350 V is applied to the second stage transfer roller 23*b* so that the second color patch is transferred from the second color photoconductive body 3*b* not to overlap in the longitudinal direction on the belt. Similarly, transfer is performed at the third and fourth stages, and then, after the reflectivity, position and the like are detected on the belt by a sensor, immediately before the first color patch comes in contact with the first stage photoconductive body 3*a* again, the transfer bias of the first stage transfer roller 23*a* is made −500 v or more. Since the first stage photoconductive body 3*a* is charged by the charging unit, the surface potential is about −500 v, the first color toner on the negatively charged belt is again transferred by the electric field to the first stage photoconductive body 3*a*, and since the developing unit has about −350 v, it is collected in the first stage developing unit 9*a*. Subsequently, after the first color patch transferred on the belt passes through the first stage photoconductive body 3*a*, +350 V is again applied to the first stage transfer roller 23*a*. By this, even if the second color toner comes in contact with the first photoconductive body 3*a*, it is not reversely transferred to the first photoconductive body 3*a*. Further, immediately before the second color toner comes in contact with the second stage photoconductive body 3*b*, the bias of the second stage transfer roller 23*b* is changed to −500 v or more. By this, the second color toner is again transferred to the second stage photoconductive body 3*b*, and similarly to the first stage, it is collected in the second stage developing unit 9*b*. As stated above, also at the third stage and the fourth stage, at similar timing, the patch images transferred on the belt are all returned to the photoconductive bodies from which they were transferred, and are collected in the developing units. Incidentally, the respective biases are examples of biases in which the experiment is performed, and any bias is effective as long as the toner is returned by electric field to the respective photoconductive bodies by changing the transfer roller bias.

Besides, in the foregoing embodiment, although the example has been described in which the intermediate transfer body is the belt, for example, the structure may be such that an intermediate transfer roller (drum) or the like is used. However, in the case of the intermediate transfer system, it is preferable that the bias applied to the first stage transfer roller 23*a* at the time when the second, third, and fourth color toner patches, which are not collected at the first stage after the patches are printed, pass through the first stage station is made lower than the bias applied to the first stage transfer roller 23*a* during normal printing, and the electric field applied to the photoconductive body and the belt is made lower than that at the time of transfer.

Specifically, in the normal printing, although, for example, +400 v is applied to the transfer roller, at the time of non-collection of a patch, it is made +300 v. This is because when the bias is high, the polarity of toner is inverted from, for example, minus to plus, and even if the bias of plus polarity is applied to the transfer roller, a "reverse transfer phenomenon" often occurs in which the inverted toner is transferred to the photoconductive body, and for example, in the case where the first stage is yellow, and the fourth stage is black, it is not preferable that black mixes with yellow. Besides, in the case where the fourth stage is the black developing unit, at the black photoconductive body 3*d*, it is appropriate that the bias of the minus (−) polarity is applied to the fourth stage transfer roller 23*d* at all positions where the first to third patches existed. By this, the toner which could not be collected by the first to the third photoconductive bodies can also be collected in the black developing unit 9*d* through the black photoconductive body 3*d*.

As a situation in which toner is attached to the belt, in addition to the operation of the control of picture quality as described above, it also occurs by a paper jam or the like. When the paper jam occurs, for example, an image is printed on the first photoconductive body 3*a*, and the image is to be transferred onto the transfer-receiving member, such as paper, on the belt, however, since there is no paper actually, the image is directly printed on the belt. In the case where only the image of the first color is transferred onto the belt, it is appropriate to return it to the first stage photoconductive body 3*a* at the time of a return operation. In this case, similarly to the foregoing case, when the image in which the paper jam has occurred passes through the first color photoconductive body 3*a*, the bias voltage applied to the first stage transfer roller 23*a* is changed to, for example, −500 v or more, so that the first color toner of the image in which the paper jam has occurred can be returned to the first stage photoconductive body.

Besides, in the case where not only the first color but also the second and subsequent colors are printed on the belt at the time of the paper jam, it is appropriate to return the toner on the belt to the black photoconductive body 3*d*. In this example, the black developing unit 9*d* is placed at the fourth stage, and at the time of a paper jam return operation, the bias to the first to the third transfer rollers is made about +350 v, and the bias of the fourth stage transfer roller 23*d* is set to −500 v or more. By this, the negatively charged toner is not returned to the photoconductive body at the first to the third stage stations, but is returned to the fourth stage black photoconductive body 3*d*, and is collected in the black developing unit 9*d*.

In this case, there is a problem that a toner of a different color is mixed in the black developing unit, and the color tone of the original black toner is changed. In the image forming apparatus of this embodiment, a method of solving this problem is provided. Here, in the case of the intermediate transfer system, it is desirable that the bias voltage applied to the first stage transfer roller 23*a* at the time of passing through the first stage station when the return operation is performed after the paper jam occurs is made lower than the bias voltage applied to the first stage transfer roller during normal printing, and the electric field applied to the photoconductive body and the belt is weakened as compared with that at the time of normal transfer.

Specifically, at the normal printing, for example, +400 v is applied to the transfer roller, however, +300 v is applied at the time of non-collection after the paper jam. This is because when the bias voltage is high (electric field is intense), the reverse transfer phenomenon often occurs, and in the case where for example, the first stage is yellow, and the fourth stage is black, it is not preferable that black mixes with yellow. In the case of the intermediate transfer system, since the secondary transfer is performed from the intermediate transfer body such as the belt to the image formed medium such as paper, at that time, a transfer residual toner is produced on the belt. In the invention, it is not made waste toner but is collected, and specifically, all are returned to the photoconductive body for black and are collected in the developing unit for black.

At this time, in the tandem type station arrangement, it is preferable that the black station is positioned at the most upstream side (first stage), and the secondary transfer residual toner is collected to the black photoconductive body side by changing the bias. First, although the secondary transfer residual toner reaches the first stage black transfer station, an inter-paper operation is performed in which image formation of a next step is not performed for one cycle of the belt. That is, as compared with the normal four-series tandem apparatus, the printing speed becomes ½.

A description will be made while FIG. 3 is used as an example. In the inter-paper operation, first, the bias of a transfer roller K5 of a black transfer station K6 is set to about −1.2 kv, and by this, among secondary transfer residual toners, one having a minus polarity is moved to a black photoconductive body K1 side, and accordingly, a toner of plus polarity remains on the belt. In a color station after this, the transfer bias is set to a minus as well, and the toner of plus polarity remains on the belt and is allowed to pass through. At this time, when the minus bias of the transfer is set to be low for the black station K6 (for example, about −800 v), reverse transfer is reduced, and accordingly, it becomes advantageous in color mixture. Thereafter, an image forming step as a next step starts, and when the toner of plus polarity on the belt reaches the black station K6, a normal transfer bias (for example, +400 v) is applied to the transfer roller K5, the image part toner on the photoconductive body is superimposed on the toner of plus polarity on the belt and is transferred, and the toner of plus polarity on the belt, which corresponds to a non-image part, is transferred to the black photoconductive body side K1 and is collected in the black developing unit K4. It should be noted that since the black station is arranged at the most upstream side, when reverse transfer occurs at the second or following stage, the black toner mixes in the color developing unit, and there is a danger that the color is changed. Then, the second stage transfer bias voltage is set to be weak as compared with the first stage black station K6, and it is necessary to prevent the reverse transfer. For example, when the bias voltage of the transfer roller K5 of the black station K6 is +400 v, and when the second stage and the following are set to +300 v, the reverse transfer can be effectively prevented. In this way, it becomes possible to collect the secondary transfer residual toner, which becomes the most serious problem in a case where the intermediate transfer system is used, into the black developing unit K4, and it becomes possible to make the waste-tonerless apparatus. As stated above, when all of the transfer residual toner of the intermediate transfer body is returned to the black developing unit, although the color is black, the color is mixed and the color is changed, and therefore, it is necessary to prevent that.

Figure 4:
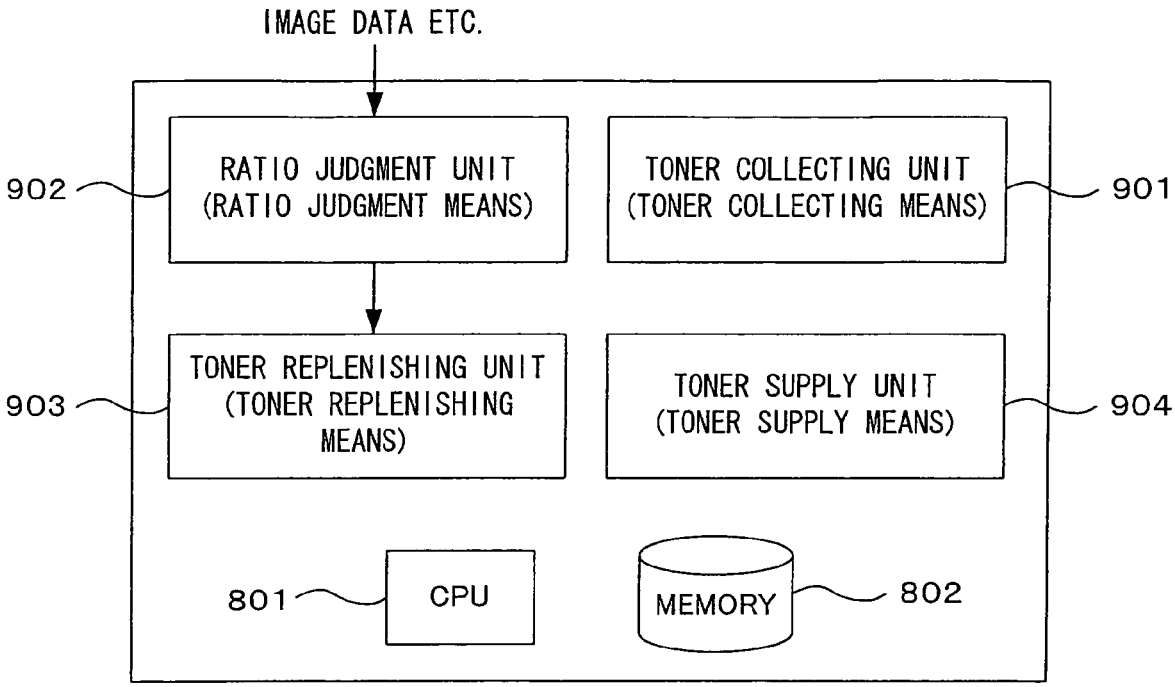
FIG. 4 is a functional block diagram for explaining an image forming apparatus according to an embodiment.

FIG. 4 is a functional block diagram for explaining the image forming apparatus of this embodiment.

Figure 10:
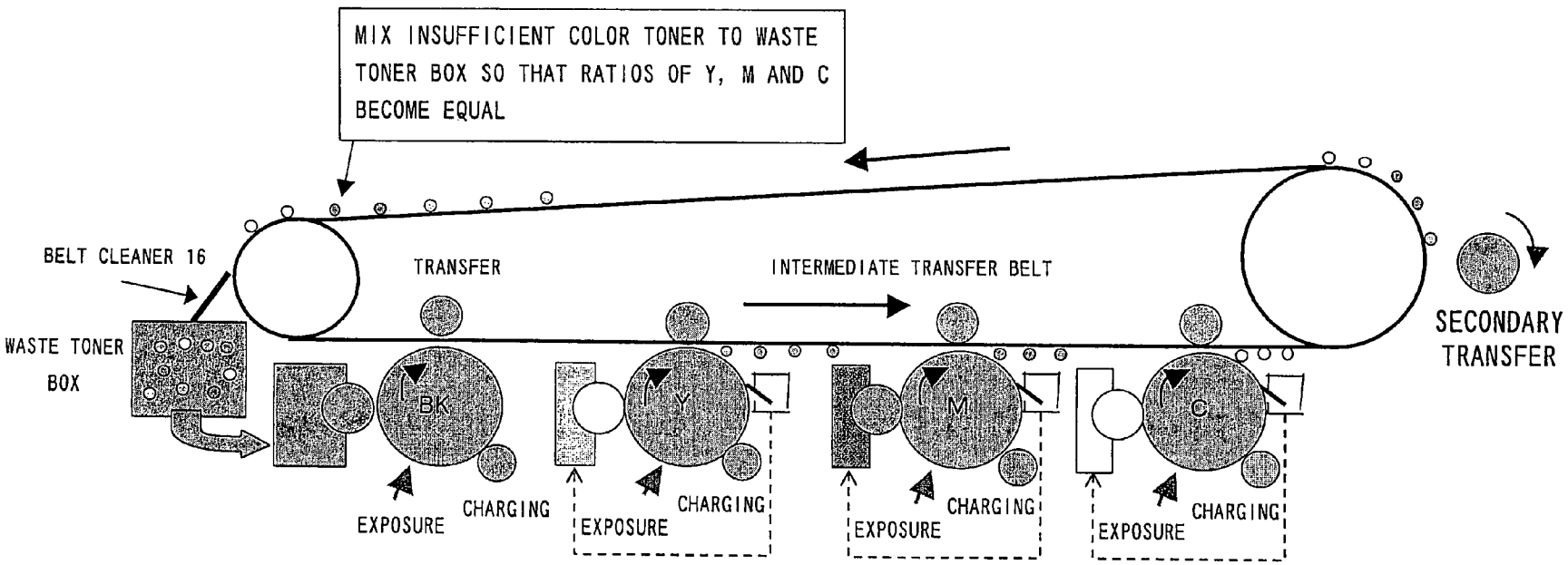
FIG. 10 is a view for explaining another example of a recycle method of waste toner.

A toner collecting unit (toner collecting means) 901 collects the toner remaining on the transfer-receiving member such as the transfer belt or intermediate transfer roller. As shown in FIG. 10, in the case where a belt cleaner (for example, a cleaning blade) 16 to remove the toner on the transfer belt as the transfer-receiving member is provided, the belt cleaner 16 corresponds to the toner collecting unit. In this case, the toner removed from the transfer-receiving member is collected in a state where all are mixed in the belt cleaner 16. On the other hand, as shown in FIG. 3, in the case where the cleaner-less system is adopted in which the toner remaining on the transfer-receiving member is collected by the photoconductive body of each process unit, each process unit has the function as the toner collecting unit.

A ratio judgment unit (ratio judgment means) 902 judges the mixing ratio of toners of plural colors included in the toners collected by the toner collecting unit 901 based on the amount of toner used (for example, the print ratio of toner calculated based on image data as a print object) in each of the plural process units. Specifically, the ratio judgment unit 902 judges the mixing ratio of toners of plural colors included in the toners collected by the toner collecting unit 901 based on the integral amount of toner used in each of the plural process units from the time when toner replenishment is performed by the toner replenishing unit 903 and the mixing ratio is adjusted to a specified ratio (from the state (at the time of shipment, at the time when exchange is performed by maintenance, at the time when balance is adjusted) where the mixture balance of toners of plural colors is adjusted).

The toner replenishing unit (toner replenishing means) 903 replenishes an insufficient color toner to the toners collected by the toner collecting unit 901 based on the mixing ratio judged by the ratio judgment unit 902, so that the mixing ratio becomes a specified ratio. Here, in the toner replenishing unit 903, since a toner of a color having a high transfer efficiency is difficult to remain on the transfer belt, the amount of replenishment may be made large for the toner of the color having the high transfer efficiency.

The specified ratio is such a mixing ratio that in the case where toners of plural colors are mixed, a color difference from the color of a normal black toner is 8 or less. Here, the reason why the color difference is made 8 or less is that in general, when the color difference exceeds "8", the user feels odd about the difference in color tone from the normal color.

Incidentally, the color difference quantitatively represents the perceptual difference of color, and in the L*a*b* color system, it is expressed by a numerical value defined by a following expression (1) of ΔE*ab.

$$\Delta E^*ab=[(\Delta L^*)\hat{}2+(\Delta a^*)\hat{}2+(\Delta b^*)\hat{}2]\hat{}½ \quad (1)$$

A toner supply part 904 supplies the toner, in which toner replenishment is performed by the toner replenishing unit 903 and the mixing ratio is adjusted to the specified ratio, to the process unit to form the black toner image.

A CPU 801 has a role to perform various processings in the image forming apparatus, and also has a role to realize various functions by executing programs stored in a MEMORY 802. The MEMORY 802 is composed of, for example, a ROM, a RAM or the like, and has a role to store various information and programs used in the image forming apparatus.

Figure 5:
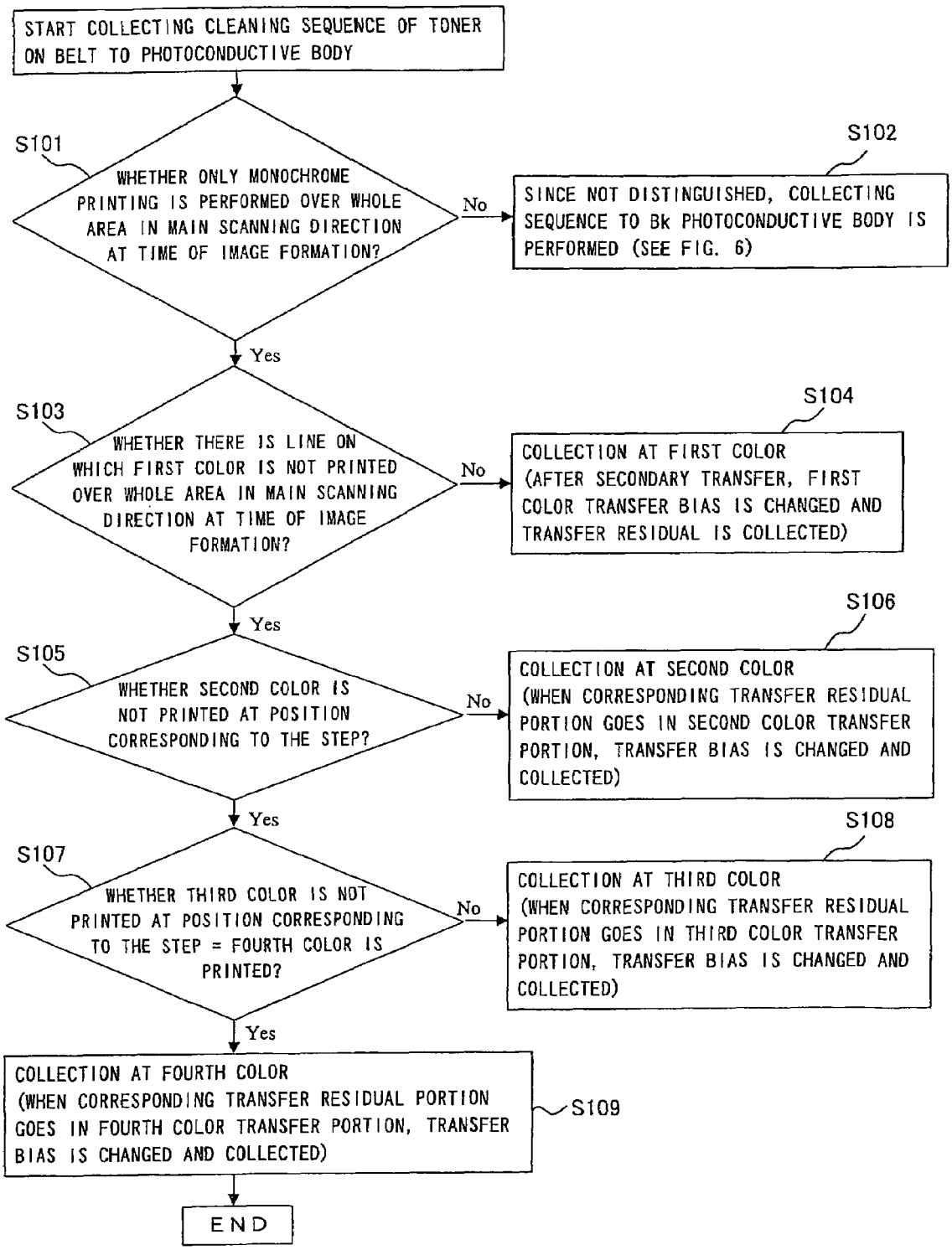
FIG. 5 is a residual toner processing flow in a cleaner-less system at a time when a monochrome toner remains in a longitudinal direction of a photoconductive body.

FIG. 5 shows a residual toner processing flow in a cleaner-less system at a time when a monochrome toner remains in the longitudinal direction of the photoconductive body. In the flowchart shown in the drawing, a processing is performed in which the monochrome toner remaining on a transfer-receiving member is collected in a developing unit of the color. In the case (S101, No) in which printing with monochrome toner does not occur over the whole area in the main scanning direction at the time of image formation, since it is impossible to distinguish toners by the color and to collect them, a shift is made to a collecting processing to the photoconductive body of the black process unit (S102).

On the other hand, printing with monochrome toner occurs over the whole area in the main scanning direction at the time of image formation (S101, Yes), and in the case where there is no line on which the first color is not printed (S103, No), the collection of the residual toner from the transfer-receiving member is performed by the first color process unit (S104).

In the case where there is a line on which the first color is not printed (S103, Yes), and the second color is printed at a position as a judgment object in the step (S105, No), the collection of the residual toner from the transfer-receiving member is performed by the second color process unit (S106).

In the case where the second color is not printed at the position as the judgment object in the step (S104, Yes), and the third color is printed at the position as the judgment object in the step (S107, No), the collection of the residual toner from the transfer-receiving member is performed by the third color processing unit (S108).

In the case where the fourth color is printed at the position as the judgment object in the step (S107, Yes), the collection of the residual toner from the transfer-receiving member is performed by the fourth color process unit (S109).

Figure 6:
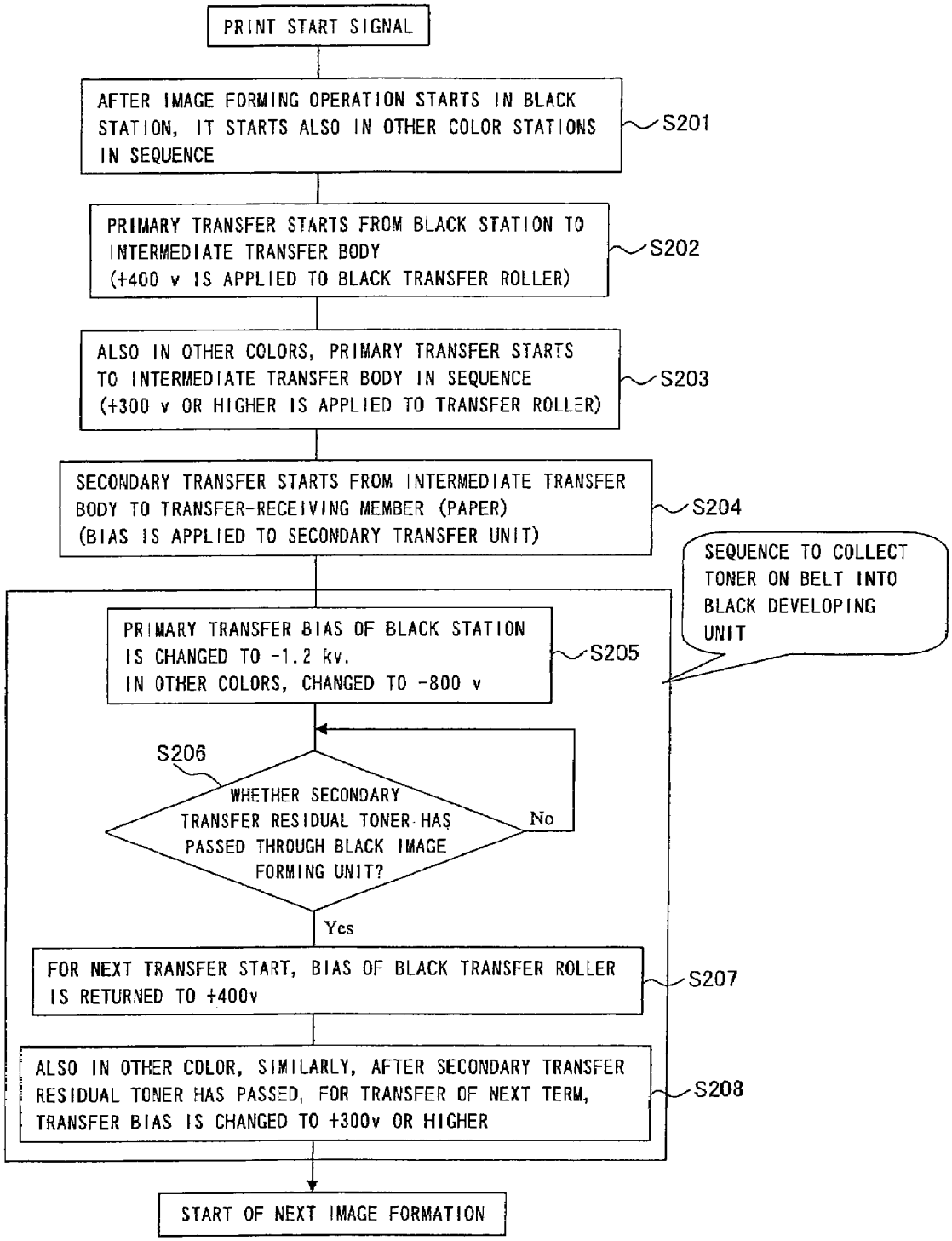
FIG. 6 is a flowchart showing a processing at a time when toners of two or more colors remain in a longitudinal direction of a photoconductive body as in a time when a paper jam occurs.
Figure 7:
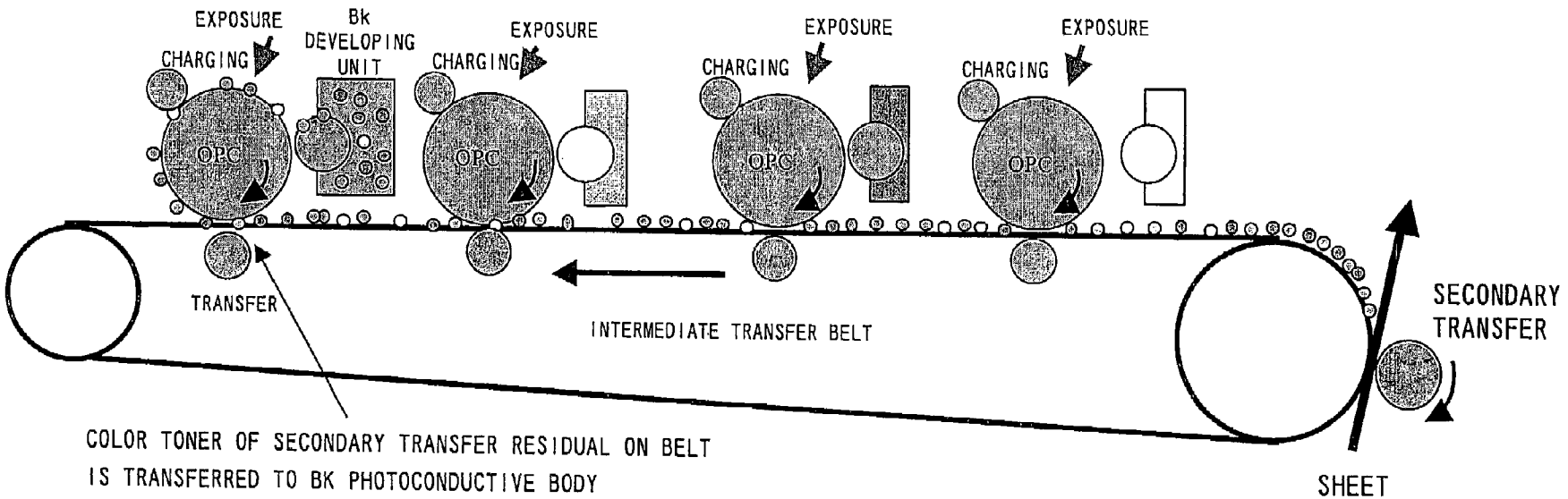
FIG. 7 is a view for explaining a collecting method of waste toner.

FIG. 6 is a flowchart showing a process when toners of two or more colors remain in the longitudinal direction of the photoconductive body as in the time when a paper jam occurs. When the residual toners are processed, based on printing information controlled from the CPU, the color in the longitudinal direction of the photoconductive body is discriminated. A monochrome portion is collected in a developing unit of a process unit of the color, and a mixed color portion is collected in a developing unit of a black process unit (in the drawing, black station) (see FIG. 7).

When the printing operation is started, after the image forming operation is started in the black station, the image forming operations in the cyan, magenta and yellow image formation stations are started in sequence (S201).

Next, the primary transfer starts from the black station to the intermediate transfer body (S202), and the primary transfer processing of a different color is also started (S203). Subsequently, the secondary transfer processing from the intermediate transfer body to the sheet is started (S204), and the primary transfer bias voltage of the black station is changed to −1.2 kv. With respect to the multi-color station, the primary transfer bias voltage is changed to −800 v (S205).

When the toner remaining on the transfer-receiving member after the secondary transfer has passed through the black station (S206, Yes), the bias voltage of the black transfer roller is returned to +400 v for the next transfer operation start (S207). Also with respect to the multi-color, similarly, after the toner remaining on the transfer-receiving member after the secondary transfer has passed through the black station, the transfer bias voltage is changed to +300 v or more for the transfer of an image of a next page (S208).

As stated above, as the collection of the color toner into the black developing unit, there are two kinds: (1) collection of mixed color toners, which have been printed on the belt at the time of a paper jam, into the black developing unit in the direct transfer system and the indirect transfer system, and (2) collection of the secondary transfer residual toner of a print image on the belt into the black developing unit in the indirect transfer. That is, in the indirect transfer system, there is always the collection of the color toner and mixed toner into the black developing unit, and this control is important.

Figure 8:
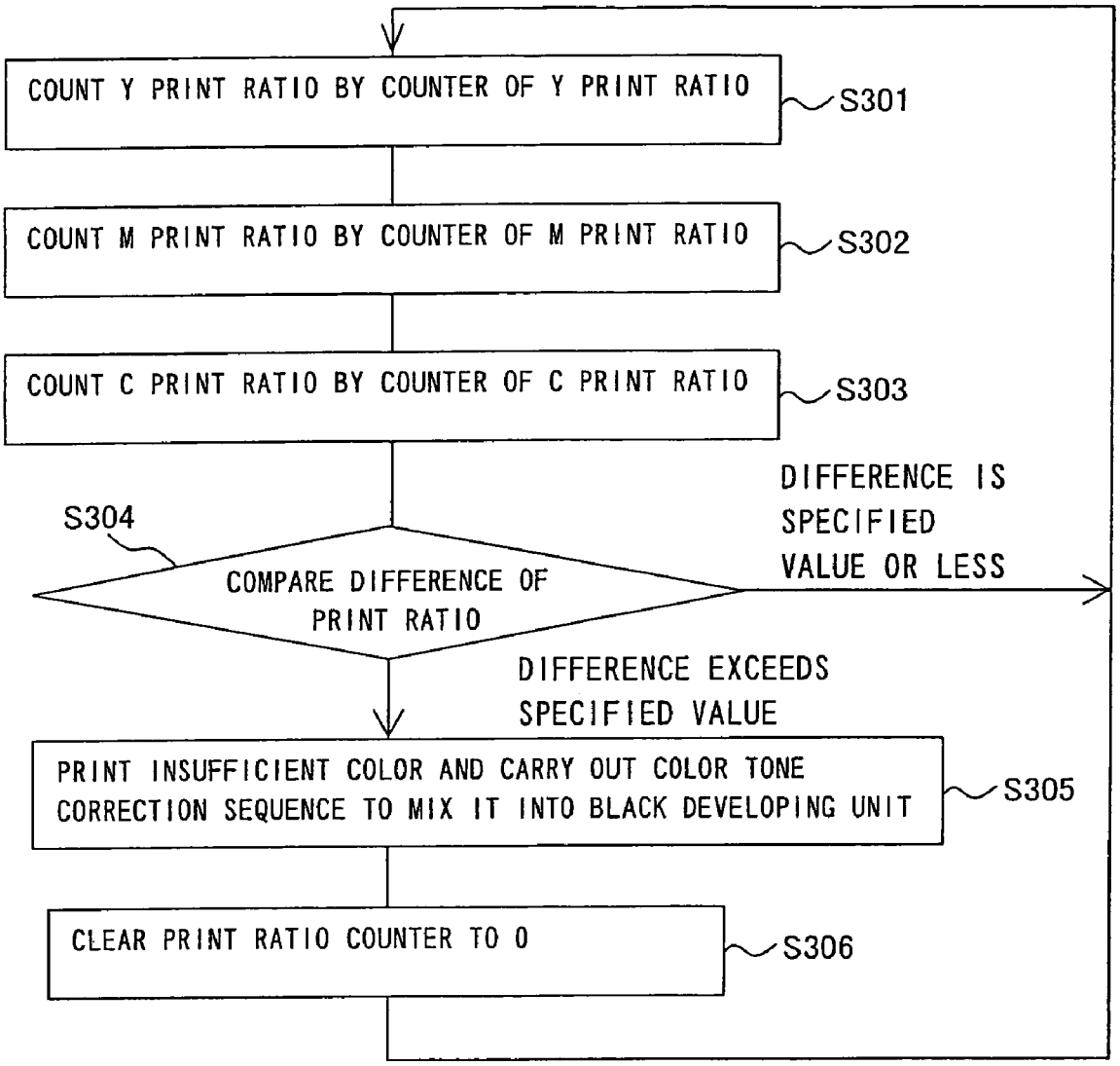
FIG. 8 is a flowchart showing an example of a color tone control sequence of waste toner.

FIG. 8 is a flowchart showing an example of a color tone control sequence of waste toner. The CPU 801 counts the print ratios of the respective colors (Y, M, C) at the time of image formation (S301 to S303). For example, at the time of start of the apparatus, or the time of end of a series of printing processes, the secondary transfer residual toner (the amount of collected toner) is estimated from the integrated print ratio.

The amount of residual transfer toner of each color toner can be estimated by amount of residual transfer toner=print ratio×image area×amount of developer toner×transfer efficiency.

The ratio judgment unit 902 estimates the respective differences of Y, M and C (S304), an insufficient toner is transferred onto the transfer-receiving member so that the respective differences are removed on the basis of the most frequently collected toner, and it is mixed with the collected toner (S305). For example, in the case where it is estimated that after printing of 100 sheets, Y of 1 mg, M of 2 mg, and C of 2 mg are collected, Y of 1 mg is mixed. For example, in the case where it is estimated that Y of 1 mg M of 2 mg and C of 3 mg are collected, Y of 2 mg and M of 1 mg are mixed. Here, in order to make the color tone of a collected toner close to the color tone of a black toner as a reference, in order that the mixing ratio of the collected toners becomes a specified ratio, an insufficient color toner is printed by the process unit, so that the toner replenishment is performed. Thus, in this embodiment, the process unit and the transfer belt serve as the toner replenishing unit. Of course, no limitation is made to this, and any means can be used as long as a desired amount of desired color toner can be mixed with the toners collected by the toner collecting unit, and for example, a structure can be made such that a toner supply unit capable of supplying respective color toners individually is provided.

Figure 9:
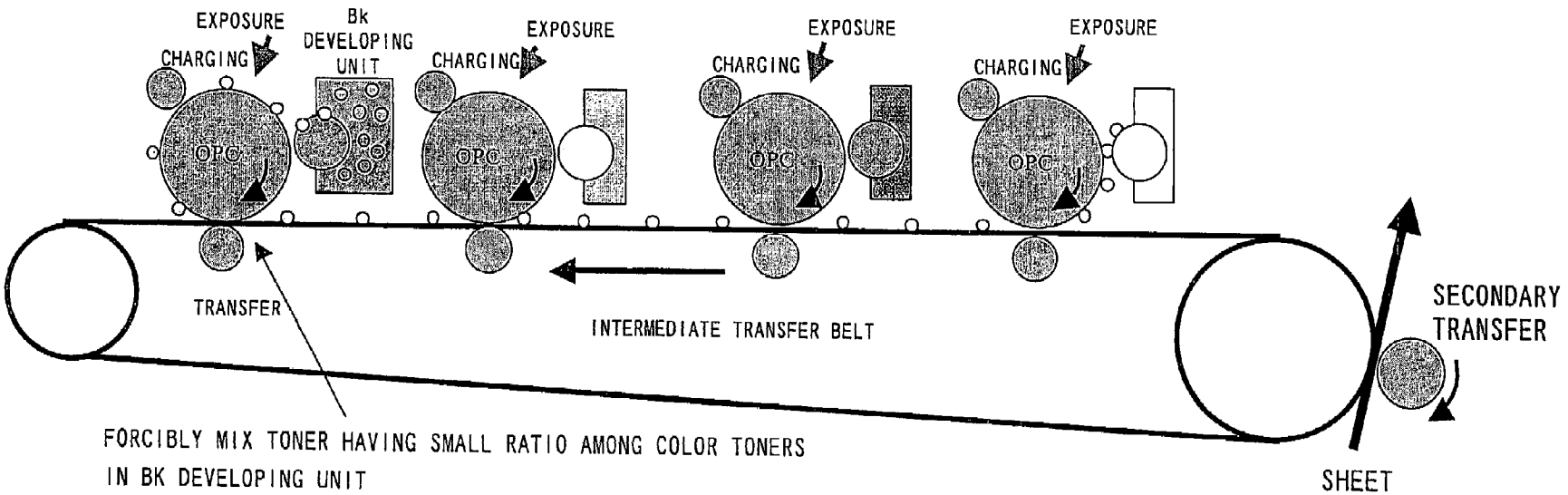
FIG. 9 is a view for explaining a collecting method of waste toner.

For example, in the mixing of a Y toner of 1 mg, the Y toner of 1 mg is developed and is transferred to the belt. That is transported to the BK photoconductive body. When passing through the intervening photoconductive bodies of M and C, a weak transfer bias of about +300 V is applied to the transfer rollers of M (23*b*) and C (23*c*). When reaching the Bk photoconductive body, −1.2 kV is applied to the BK transfer roller (23*d*), the toner on the belt is transferred to the photoconductive body side, and is collected in the Bk developing unit (see FIG. 9). As stated above, when the control is performed so that the ratios of the amounts of collected toners of respective colors become almost equal, the color tone of black can be kept. After this control is performed, the print ratio counter is reset (S306).

Incidentally, in the foregoing embodiment, although the structure has been described in which the collection of the toner remaining on the transfer-receiving member is performed by the photoconductive body in each of the process units, no limitation is made to this, and for example, as shown in FIG. 10, a belt cleaner to scrape a toner from a belt surface of an intermediate transfer belt as the transfer-receiving member is provided, and the residual toner on the intermediate transfer belt may be collected by the belt cleaner. In this case, the waste toner scraped by the belt cleaner is stored in the waste toner box of the belt cleaner. Besides, a cleaner (collecting unit of toner on photoconductive surface) to collect the toner remaining on the photoconductive surface of the photoconductive body is provided in the process unit to form a toner image of a color other than black, and the toner collected from the photoconductive surface by the cleaner may be supplied to the developing unit in the process unit in which the cleaner is provided.

Besides, as shown in FIG. 10, in the case where the process unit to form the black toner image is disposed at the most upstream side in the movement direction of the transfer-receiving member (in the case where deterioration in picture quality is apt to become severe when reverse transfer occurs), the structure can be made such that the toner collected from the photoconductive surface by the cleaner in the process unit to form the toner image of a color other than black is supplied to the developing unit of the process unit to form the black toner image.

Figure 11:
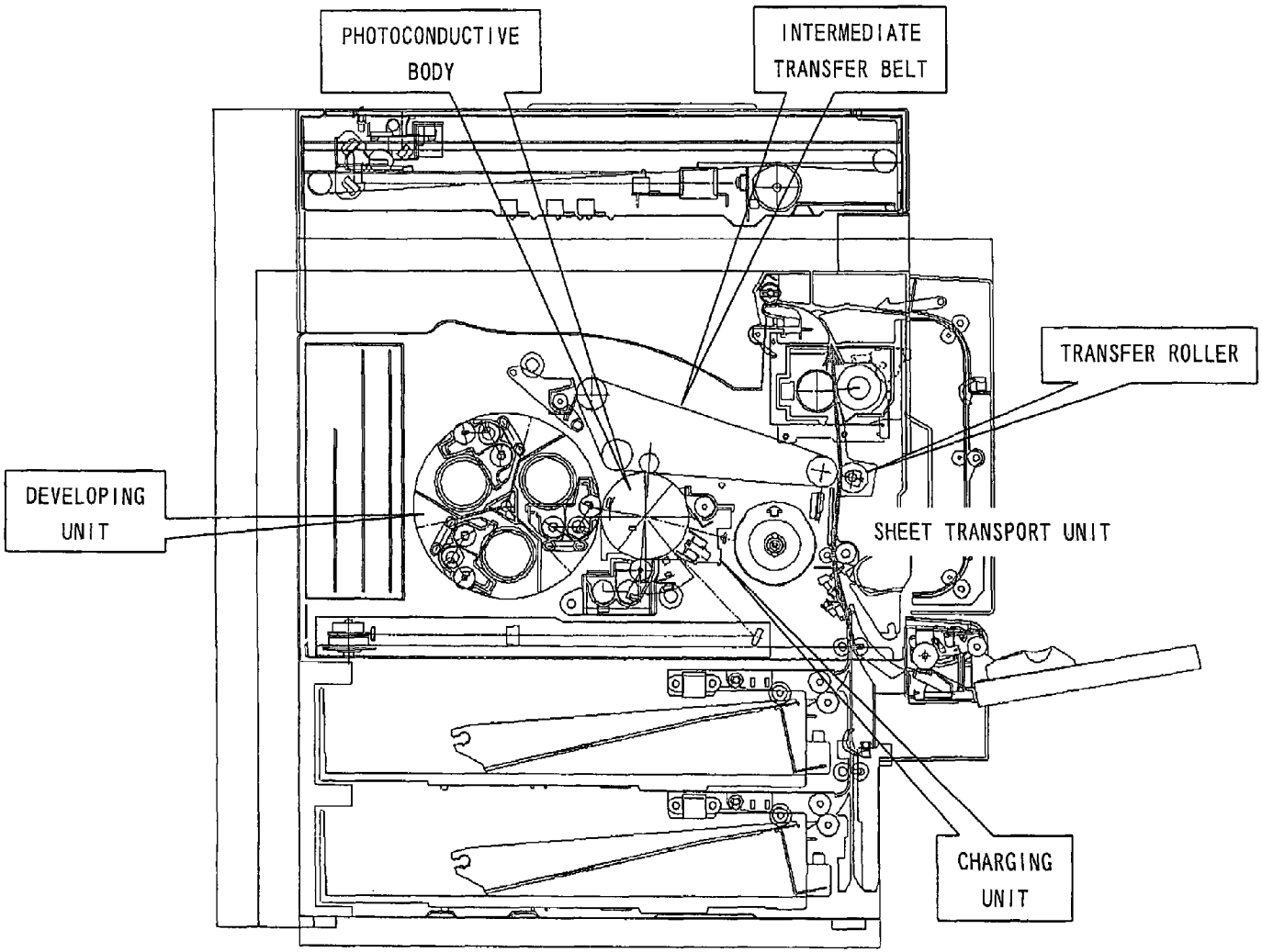
FIG. 11 is view showing a schematic structure of an image forming apparatus of a four-rotation drum intermediate transfer belt system.

Besides, in this embodiment, although the structure of the so-called tandem system image forming apparatus has been used as the example, no limitation is made to this, and for example, the same effect can be obtained also in the case where the invention is applied to the image forming apparatus of the so-called four-rotation drum intermediate transfer belt system as shown in FIG. 11.

Subsequently, in the foregoing embodiment, grounds for performing the toner replenishment in the toner replenishing unit so that the color difference becomes 8 or less will be described.

The following are measured data indicating a relation between a mixing ratio (weight ratio) of Y (yellow) toner, M (magenta) toner, and C (cyan) toner and a color difference (ΔE*ab) from pure BK (black) toner, while the mixing ratio is changed several times.

| Y | M | C | color difference | result |
|---|---|---|---|---|
| 1 | 1 | 1 | 9.53 | NG |
| 1.2 | 1 | 1.1 | 3.77 | OK |
| 1.3 | 1 | 1.2 | 5.83 | OK |
| 1.4 | 1 | 1 | 6.35 | OK |
| 1.2 | 1 | 1 | 6.43 | OK |
| 1 | 1 | 1.2 | 7.83 | OK |
| 1 | 1.2 | 1 | 14.57 | NG |

As stated above, Y:M:C=1.2:1:1.1 is the optimum mixing ratio at which the color difference from the black toner becomes smallest, and the color difference is 3.77. Besides, it is understood that also at 1.3:1:1.2, it is in an allowable range. Besides, when the other two colors are made "1" and the ratio of the remaining color is changed, the allowable range of Y is wide, and even when it was "1.4", a problem did not occur in the color tone. With respect to the C toner, 1.2 was a limit.

Hereinafter, an example of a calculation method of a color difference from a standard black toner will be described.

In the case where L*a*b* of the initial pure Bk is (20.0, 1.5, −0.5), when L*a*b* of a BK print image after printing of 1000 sheets is (20.5, 5.5, −1.5), the color difference becomes $$\Delta E^*ab=[(0.5)^2+4^2+(-1)^2]^{1/2}=4.2 \quad (2)$$

Further, in the case where L*a*b* of a print image of Bk after 2000 sheets have passed is (20.3, 9.0, 2.2), the color difference ΔE*ab becomes $$[(0.3)^2+(7.5)^2+(2.7)^2]^{1/2}=8.0 \quad (3)$$

Besides, when L*a*b* of a print image of Bk after 3000 sheets have passed is (20.5, 12.2, −3.1), the color difference ΔE*ab becomes $$[(0.5)^2+(10.7)^2+(-2.6)^2]^{1/2}=11.0 \quad (4)$$

Incidentally, for the measurement of the color difference, the X-Rite 938 Spectrodensitometer of X-Rite, Inc was used. The observation conditions were such that the light source was D50, and an angle of visibility was 2°, and the measurement was made in the L*a*b* color system. The color difference was measured by ΔE*ab.

FIG. 12 is a table showing a relation between a color difference and a sensory evaluation result of a color tone. As shown in the drawing, it is understood that when the color difference from the black toner as a reference exceeds "8", the evaluator feels odd about the difference of the color tone. Thus, in this embodiment, the color difference "8" is a limit value.

Incidentally, according to the embodiment, it is possible to provide a toner recycle method which is for an image forming apparatus to perform an image forming processing by plural image forming units to transfer toner images of colors different from each other onto a transfer-receiving member moved in a specified direction, and includes collecting toners remaining on the transfer-receiving member, judging a mixing ratio of toners of plural colors included in the collected toners, and replenishing an insufficient color toner to the collected toners based on the judged mixing ratio so that the mixing ratio becomes a specified ratio. In the toner recycle method as stated above, the mixing ratio of the toners of plural colors included in the collected toners can be judged based on the amount of toner used in each of the plural image forming units. Besides, in the toner recycle method as stated above, the mixing ratio of the toners of plural colors included in the collected toners can be judged based on the integrated amount of toner used in each of the plural image forming units from a time when toner replenishment is performed and the mixing ratio is adjusted to the specified ratio. Besides, in the recycle method as stated above, when the insufficient color toner is replenished, the amount of replenishment can be increased for a toner having a high transfer efficiency. Besides, in the toner recycle method as stated above, the specified ratio can be made a mixing ratio in which in a case where toners of plural colors are mixed, a color difference from a color of a normal black toner is 8 or less. Besides, in the toner recycle method as stated above, the plural image forming units include an image forming unit to form a black toner image, and the toner in which the toner replenishment is performed and the mixing ratio is adjusted to the specified ratio can be supplied to the image forming unit to form the black toner image. Besides, in the toner recycle method as stated above, the plural image forming units include an image forming unit to form a black toner image and an image forming unit to form a toner image of a color other than black, and in the image forming unit to form the toner image of the color other than black, a toner remaining on a photoconductive surface of a photoconductive body is collected, and the toner collected from the photoconductive body can be supplied to a developing unit in the image forming unit in which the photoconductive body is provided. Besides, in the toner recycle method as stated above, the plural image forming units include an image forming unit to form a black toner image and an image forming unit to form a toner image of a color other than black, the image forming unit to form the black toner image is disposed at the most upstream side in a specified direction, and in the image forming unit to form the toner image of the color other than black, a toner remaining on a photoconductive surface of the photoconductive body is collected, and the toner collected from the photoconductive surface can also be collected as the toner reused in the image forming unit to form the black toner image.

According to the embodiment, it is possible to provide the image forming apparatus of the structure in which the residual toner on the transfer-receiving member, such as the transfer belt, is transferred to the photoconductive body in the black process unit and is returned, is collected in the black developing unit, and is reused as the black toner. That is, a cleaning device for the transfer belt is also removed, and the completely cleaner-less image forming apparatus is obtained. By this, since waste toner is not produced at all, the toner consumption cost is greatly reduced, and the cost of waste toner processing becomes unnecessary.

Further, according to this embodiment, it is possible to provide the method of recycling the collected toner as the black toner. By using the black toner controlled so that the black color tone is not changed by the mixture of another color toner, an image in which the color tone of the black image is not changed can be obtained. That is, the feature is such that the print ratio of each of colors of color toners is counted, the mixture amount of the color toner into the Bk developing unit is estimated by this, and in the case of insufficiency, the color is mixed, so that the color tone of black is automatically controlled, and the problem of the change in the color tone of black is also solved. By this, the toner which has been discarded heretofore can be reused as the black toner, and it is possible to provide the image forming apparatus and the toner recycle method to reduce the toner consumption cost.

In this embodiment, although the case where the function to carry out the invention is previously recorded in the inside of the apparatus has been described, no limitation is made to this, and a similar function may be downloaded from a network to the apparatus, or a similar function stored in a recording medium may be installed in the apparatus. The recording medium may have any mode as long as a program can be stored and the apparatus can read, such as a CD-ROM. Besides, the function previously obtained by the installation or download cooperates with the OS (Operating System) or the like in the inside of the apparatus and may realize the function.

Although the invention has been described in detail with the specific aspect, it would be obvious for one skilled in the art that various modifications and improvements can be made insofar as they do not depart from the spirit and scope of the invention.

As described above in detail, according to the invention, in the case where the image forming processing with the toners of plural colors is performed, it is possible to provide the technique in which the residual toner on the transfer-receiving member to which the toner images are transferred by the plural image forming units is not discarded, but is reused as the black toner, and the deterioration of picture quality due to the color tone change of the black toner is prevented.

What is claimed is:

1. An image forming apparatus to perform an image forming processing to form toner images of colors different from each other, comprising:

photoconductive bodies, each photoconductive body comprising a developing unit, the developing unit being configured to develop an electrostatic latent image on the surface of the photoconductive body and collect a residual toner remaining on the photoconductive body;

image forming units for each color which superimpose the toner image on the photoconductive body on an intermediate transfer body moved in a specified direction, the intermediate transfer body transferring the superimposed toner image to a recording medium, a residual toner remaining on the intermediate transfer body after transferring the toner image to the recording medium being collected by a black developing unit via the photoconductive body, the image forming units for each color other than black transferring necessary toners to the intermediate transfer body based on detected amounts of plural color toners, and the black developing unit collecting the toners via the photoconductive body of the black image forming unit;

a toner collecting unit configured to collect toners remaining on the intermediate transfer body;

a ratio judgment unit configured to judge a mixing ratio of toners of plural colors included in the toners collected by the toner collecting unit; and a toner replenishing unit configured to replenish an insufficient color toner to the toners collected by the toner collecting unit based on the mixing ratio judged by the ratio judgment unit so that the mixing ratio becomes a specified ratio.

2. The image forming apparatus according to claim 1, wherein the ratio judgment unit judges, based on the amount of toner used in each of the plural image forming units, the mixing ratio of the toners of plural colors included in the toners collected by the toner collecting unit.

3. The image forming apparatus according to claim 1, wherein the ratio judgment unit judges, based on the integrated amount of toner used in each of the plural image forming units from a time when the toner replenishment is performed by the toner replenishing unit and the mixing ratio is adjusted to the specified ratio, the mixing ratio of the toners of plural colors included in the toners collected by the toner collecting unit.

4. The image forming apparatus according to claim 1, wherein the amount of toner used is a toner print ratio calculated based on image data as a print object.

5. The image forming apparatus according to claim 1, wherein the toner replenishing unit increases the amount of replenishment for a toner of a color having a high transfer efficiency.

6. The image forming apparatus according to claim 1, wherein the specified ratio is a mixing ratio in which in a case where the toners of plural colors are mixed, a color difference from a color of a normal black toner is 8 or less.

7. The image forming apparatus according to claim 1, wherein the plural image forming units include an image forming unit to form a black toner image, and a toner supply unit supplies the toner, in which the toner replenishment is performed by the toner replenishing unit and the mixing ratio is adjusted to the specified ratio, to the image forming unit to form the black toner image.

8. The image forming apparatus according to claim 1, wherein the plural image forming units include an image forming unit to form a black toner image and an image forming unit to form a toner image of a color other than black, the image forming unit to form the toner image of the color other than black includes a photoconductive surface toner collecting unit configured to collect a toner remaining on a photoconductive surface of a photoconductive body, and the photoconductive surface toner collecting unit supplies the toner collected from the photoconductive surface to a developing unit in the image forming unit in which the photoconductive surface toner collecting unit is provided.

9. The image forming apparatus according to claim 1, wherein the plural image forming units includes an image forming unit to form a black toner image and an image forming unit to form a toner image of a color other than black, the image forming unit to form the black toner image is disposed at the most upstream side in the specified direction, the image forming unit to form the toner image of the color other than black includes a photoconductive surface toner collecting unit to collect a toner remaining on a photoconductive surface of a photoconductive body, and the toner collecting unit collects the toner collected from the photoconductive surface by the photoconductive surface toner collecting unit.

10. The image forming apparatus according to claim 1, further comprising a process unit to integrally support a photoconductive body and at least one of a charging unit to charge a surface of the photoconductive body and a developing unit to develop an electrostatic latent image formed on the photoconductive body, wherein the process unit is detachably mounted in a body of the image forming apparatus.

11. The image forming apparatus according to claim 1, wherein image patches are sequentially transferred from the respective photoconductive bodies to the intermediate transfer body so that the image patches do not overlap with each other.

12. The image forming apparatus according to claim 11, wherein the image patches are sequentially transferred from the respective photoconductive bodies to the intermediate transfer body by applying a transfer voltage to a transfer roller.

13. The image forming apparatus according to claim 11, wherein positions of respective image patches on the intermediate transfer body are detected a sensor.

14. The image forming apparatus according to claim 12, wherein the image patches on the intermediate transfer body are collected by applying a voltage that has a reverse polarity to the transferring voltage.

15. The image forming apparatus according to claim 12, wherein when the image patches on the intermediate transfer body are not collected, the transfer voltage is applied.

16. An image forming apparatus to perform an image forming processing to form toner images of colors different from each other, comprising:

photoconductive means for having an electrostatic latent image on the surface of the photoconductive means;

developing means for developing the electrostatic latent image on the surface of the photoconductive means and for collecting a residual toner remaining on the photoconductive body;

image forming means for each color for superimposing the toner image on the photoconductive means on intermediate transfer means moved in a specified direction, the intermediate transfer means transferring the superimposed toner image to recording means, a residual toner remaining on the intermediate transfer means after transferring the toner image to the recording means being collected by a black developing means via the photoconductive means, the image forming means for each color other than black transferring necessary toners to the intermediate transfer means based on detected amounts of plural color toners, and the black developing means collecting the toners via the photoconductive means of the black image forming means;

toner collecting means for collecting toners remaining on the intermediate transfer means;

ratio judgment means for judging a mixing ratio of toners of plural colors included in the toners collected by the toner collecting means; and toner replenishing means for replenishing an insufficient color toner to the toners collected by the toner collection means based on the mixing ratio judged by the ratio judgment means so that the mixing ratio becomes a specified ratio.

17. A toner recycle method for an image forming apparatus to perform an image forming processing by plural image forming units to form toner images of colors different from each other on a transfer-receiving member moved in a specified direction, comprising:

developing an electrostatic latent image on a surface of a photoconductive body;

superimposing the toner image on the photoconductive body on an intermediate transfer body moved in a specified direction;

transferring the superimposed toner image to a recording medium;

collecting a residual toner remaining on the photoconductive body;

collecting toners remaining on the intermediate transfer body by a black developing unit via the photoconductive body after transferring the toner image to the recording medium;

judging a mixing ratio of toners of plural colors included in the collected toners;

replenishing an insufficient color toner to the collected toners based on the judged mixing ratio so that the mixing ratio becomes a specified ratio;

transferring necessary toners to the intermediate transfer body based on a detected amount of plural color toners by the image forming units for each color other than black; and collecting the toners via the photoconductive body of the black image forming unit by the black developing unit.

18. The toner recycle method according to claim 17, wherein the mixing ratio of the toners of plural colors included in the collected toners is judged based on the amount of toner used in each of the plural image forming units.

19. The toner recycle method according to claim 17, wherein the mixing ratio of the toners of plural colors included in the collected toners is judged based on the integrated amount of toner used in each of the plural image forming units from a time when the toner replenishment is performed and the mixing ratio is adjusted to a specified ratio.

20. The toner recycle method according to claim 17, wherein when the insufficient color toner is replenished, the amount of replenishment for a toner of a color having a high transfer efficiency is increased.

21. The toner recycle method according to claim 17, wherein the specified ratio is a mixing ration in which in a case where the toners of plural colors are mixed, a color difference from a color of a normal black toner is 8 or less.

22. The toner recycle method according to claim 17, wherein the plural image forming units include an image forming unit to form a black toner image, and the toner in which the toner replenishment is performed and the mixing ratio is adjusted to the specified ratio is supplied to the image forming unit to form the black toner image.

23. The toner recycle method according to claim 17, wherein the plural image forming units include an image forming unit to form a black toner image and an image forming unit to form a toner image of a color other than black, a toner remaining on a photoconductive surface of a photoconductive body is collected in the image forming unit to form the toner image of the color other than black, and the toner collected from the photoconductive body is supplied to a developing unit in the image forming unit in which the photoconductive body is provided.

24. The toner recycle method according to claim 17, wherein the plural image forming units includes an image forming unit to form a black toner image and an image forming unit to form a toner image of a color other than black, the image forming unit to form the black toner image is disposed at the most upstream side in the specified direction, a toner remaining on a photoconductive surface of a photoconductive body is collected in the image forming unit to form the toner image of the color other than black, and the toner collected from the photoconductive surface is collected as the toner reused in the image forming unit to form the black toner image.

* * * * *